US005444523A

United States Patent [19]

Sameshima et al.

[11] Patent Number: 5,444,523

[45] Date of Patent: Aug. 22, 1995

[54] IMAGE FORMING DEVICE INCLUDING TRANSFER MATERIAL CARRIER DEVICE WITH GROUNDING MEMBER

[75] Inventors: Junichirou Sameshima; Norio Hokari; Satoshi Honobe, all of Kanagawa, Japan

[73] Assignee: Fuji Xerox Co., Ltd., Tokyo, Japan

[21] Appl. No.: 205,481

[22] Filed: Mar. 4, 1994

[30] Foreign Application Priority Data

Mar. 5, 1993 [JP] Japan ..... 5-044777

[51] Int. Cl.[6] ..... G03G 15/00

[52] U.S. Cl. ..... 355/309; 355/274; 361/214

[58] Field of Search ..... 355/271, 274, 275, 308, 355/309; 271/208; 474/90; 198/803.6, 691; 361/212, 214; 174/5 R, 5 SG, 51

[56] References Cited

U.S. PATENT DOCUMENTS

| | | | |
|---|---|---|---|
| 2,375,304 | 5/1945 | Kilduff | 361/212 |
| 3,690,646 | 9/1972 | Kolibas | 271/45 |
| 4,385,824 | 5/1983 | Hollo | 361/212 X |
| 4,494,166 | 1/1985 | Billings et al. | 361/214 |
| 4,688,931 | 8/1987 | Hermkens | 271/208 X |
| 4,994,861 | 2/1991 | Brandon et al. | 355/274 |
| 5,043,759 | 8/1991 | Sakai | 361/214 X |
| 5,065,196 | 11/1991 | Kanaya et al. | 355/308 |
| 5,134,443 | 7/1992 | Sumi et al. | 355/309 |
| 5,335,053 | 8/1994 | Hasegawa | 355/274 |

FOREIGN PATENT DOCUMENTS

| | | |
|---|---|---|
| 0124360 | 8/1982 | Japan . |
| 0185448 | 11/1982 | Japan . |
| 63-47245 | 2/1988 | Japan . |
| 0147541 | 6/1990 | Japan . |
| 0159943 | 5/1992 | Japan . |

*Primary Examiner*—Robert Beatty

*Attorney, Agent, or Firm*—Finnegan, Henderson Farabow, Garrett & Dunner

[57] ABSTRACT

An image forming device includes a transfer material carrier unit which absorbs a transfer material onto a transfer material carrier by use of an electrostatic force and carries the transfer material. The image forming device further includes a unit for connecting the transfer material carrier unit with an image forming device main body, a unit for drawing out the transfer material carrier unit from the image forming device main body by releasing the connection to the connecting unit, and a conductive grounding member disposed in the image forming device main body such that it is opposed to the transfer material and there is provided space between the conductive grounding member and the transfer material when the transfer material carrier unit is drawn out. Further, the image forming device is characterized in that when the image forming device main body is grounded, and in the connected condition, there is formed a path for discharging electric charges from the transfer material carrier unit drawing-out unit through the transfer material carrier unit and connecting unit, and, in the connection removed condition, electricity is removed by the conductive grounding member.

5 Claims, 3 Drawing Sheets

IMAGE FORMING DEVICE INCLUDING TRANSFER MATERIAL CARRIER DEVICE WITH GROUNDING MEMBER

BACKGROUND OF THE INVENTION

The present invention relates to an image forming device including transfer material carrier means which absorbs transfer material onto a transfer material carrier by use of static electricity and carries such transfer material. In particular the present invention relates to an image forming device which has a function to remove electricity from the transfer material absorbed onto the transfer material carrier means.

Conventionally, in an image forming device such as a copying machine, when paper clogging occurs in the course of carrying the transfer paper by means of a transfer belt, as disclosed in Japanese Patent Unexamined Publication No. Sho. 63-47245, the paper clogging is detected by detection means provided internally of the copying machine, and the contact of photosensitive material with the transfer belt is removed in accordance with such detection, which can prevent the photosensitive material from being damaged and can facilitate the removal of the clogged paper.

On the transfer paper on the insulating transfer belt, there are left electric charges which have been given during transfer, and the charges are stored into the body of an operator through the hand of the operator when the operator touches the transfer paper to remove the paper clogging. After that, if the operator touches a grounded conductor, then the electric charges are discharged to give electric shocks to the operator. Or, when removing the paper, a leak occurs between the electric charges previously stored in the operator's body and the electric charges of the transfer paper to thereby give electric shocks to the operator.

In a transfer paper carrier device which absorbs transfer paper by means of an electrostatic force onto a film member, if the transfer paper is charged with electric charges and the transfer paper is clogged while it exists on the film member, then the electric charges of the transfer paper are stored into the body of an operator when he or she tries of remove the clogged paper and, after removal of the transfer paper, if the operator touches a conductor, then the conductor is discharged to thereby apply electric shocks to the operator.

In order to avoid the above problems, as disclosed in Japanese Patent Unexamined Publication No. Hei. 6-59534, there is proposed a method in which an operation part to be touched by an operator is grounded through an electric resistor or a semiconductor and, when removing the clogged paper, after electric charges stored in the body of the operator are gradually removed or are neutralized, the operator touches the transfer paper, thereby preventing generation of electric shocks.

However, in a large-size copying machine which is capable of putting 4 sheets of A4 size transfer paper or 2 sheets of A3 size transfer paper on a transfer belt, two or more sheets of transfer paper may be clogged, in which stored charges cannot be neutralized because the quantity of charges stored in the transfer paper is large, so that the charges will be stored immediately in the body of an operator. That is, the above problem cannot be solved perfectly by the method disclosed in Japanese Patent Publication No. HEI 6-59534.

SUMMARY OF THE INVENTION

In view of the above, it is an object of the present invention to provide an image forming device which can enhance an electricity removing effect in removing paper clogging to thereby reduce electric shocks.

In achieving the above object, according to the present invention, there is provided an image forming device including transfer material carrier means which absorbs a transfer material onto a transfer carrier member by use of an electrostatic force and carries the transfer material, the image forming device comprising: means for connecting the transfer material carrier means with an image forming device main body; means for drawing out the transfer material carrier means from the inside of the image forming device main body by releasing the connection of the connecting means; and a conductive grounding member provided in the image forming device main body such that it is opposed to the transfer material and there is space between the conductive grounding member and the transfer material when the transfer material carrier means is drawn out; wherein the image forming device main body is grounded, a path is formed which discharges electric charges from the transfer material carrier means drawing-out means through the transfer material carrier means and connecting means in the connected state, and the electric charges are removed by the conductive grounding member in the connection removed state.

The conductive grounding member may be preferably provided almost over the whole areas of the transfer material carrying surface of the transfer material carrier means and at a space distance corresponding to the quantity of charges of the transfer material, because a high electricity removing effect can be obtained. However, alternatively, the conductive grounding member may also be provided in a part of the carrying surface.

The conductive grounding member may be composed of means which generates charges in such a manner that an electric field can be formed concentratedly to neutralize the electric charges stored in the transfer material, or the conductive grounding member may be connected to a high voltage supply source so that electricity can be removed forcibly.

According to the invention, when removing the paper clogging, when the connection between the transfer material carrier means and the image forming device main body is removed and the transfer material carrier means is drawn out from the inside of the image forming device main body, the transfer material held by the transfer material carrier means is moved while it is opposed to the conductive grounding member but not in contact with the member. As a result, the charges left in the transfer material are removed from the conductive grounding member and, therefore, the quantity of charges stored in the body of an operator can also be reduced. Thus, after such electricity removal, even if the operator touches other conductors, no electric shocks will be given to the operator. Also, in the start of the paper clogging removing operation, the transfer material carrier means and the image forming device main body are being connected with each other and thus a discharge path is formed between means such as an operation handle for drawing out the transfer material carrier means and the grounded image forming device main body, so that the charges stored in the human body are discharged through the discharge path to prevent the operator from suffering from electric shocks.

DETAILED DESCRIPTION OF THE PREFERRED EMBODIMENTS

Figure 4:
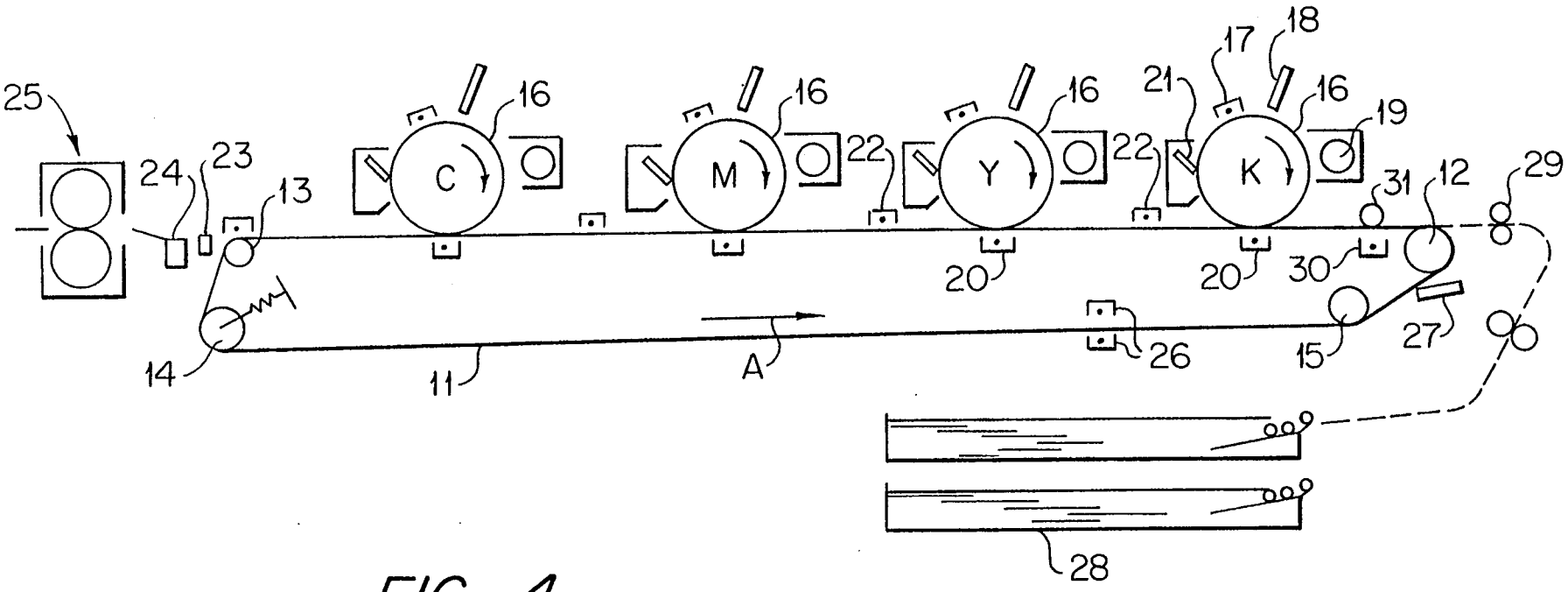
FIG. 4 is a schematic section view of an image forming device to which the present invention is applied.

Now, preferred embodiments of the present invention will be described with reference to the accompanying drawings. FIG. 4 is a structure view, partly in section, of the whole of a color image forming device in which the present invention is applied to a transfer material carrying belt. However, the present invention is not limited to such type of image forming device but can also be applied to a single color image forming device. Also, the present invention is not limited to a transfer material carrying belt but can also be applied to other kinds of belts such as a belt for an intermediate transfer material, a transfer material carrying drum, or the like.

A transfer material carrying belt 11 consists of an endless belt with a dielectric film coated thereon and is wound round a drive roller 12 and rotary rollers 13, 14 and 15 so that it can be rotated in a direction of an arrow A shown in FIG. 4. Opposite to the upper surface of the transfer material carrying belt 11, there are disposed four sets of image forming units K, Y, M and C respectively for black, yellow, magenta and cyan.

Each of the image forming units K, Y, M and C comprises an image carrier 16 formed of a photosensitive drum, a charge corotron 17, latent image write means 18, a developing device 19, a transfer corotron 20, an image carrying cleaner 21 and the like. Downstream of each of the image forming units K, Y and M, there is disposed a transfer material electricity removing corotron 22 and the image carriers 16 are respectively rotated in the direction of arrows shown in FIG. 4.

Downstream of the image forming unit C formed in the final stage, there are disposed a peel-off corotron 23, a peel-off claw 24 and a fixing device 25. Upstream of the rotary roller 12 on the side of the image forming unit K formed in the first stage, there are disposed a carrying belt electricity removing corotron 26 and a cleaning blade 27. Also, downstream of the rotary roller 12, there is disposed an absorbing corotron 30 inside the transfer material carrying belt and, opposite to the absorbing corotron 30, there is disposed a transfer material absorbing roller 31. The transfer material in a paper feed tray 28 is delivered to the transfer material carrying belt 11 through roller 29 and then, the transfer material is absorbed onto the transfer material carrying belt 11 by means of the absorbing corotron 30 and transfer material absorbing roller 31.

In the above-mentioned image forming device, the image carrier 16 is uniformly charged by the charge corotron 17, the image of a manuscript is exposed by latent image write means 18, and an electrostatic latent image is formed on the image carrier 16. A toner is contacted with the surface of the image carrier 16 in the developing device 19 to thereby form a toner image and the developed toner image is transferred to the transfer material on the transfer material carrying belt in the transfer corotron 20. The toners left on the image carrier 16 are scraped off by the cleaner 21 to thereby perform a series of image forming cycles and such cycle is executed by the four sets of image forming units K, Y, M and C, so that a plurality of toner images are transferred sequentially and superimposingly one on top of another onto the transfer material to be absorbed and carried by the transfer material carrying belt 11.

Figure 1A:
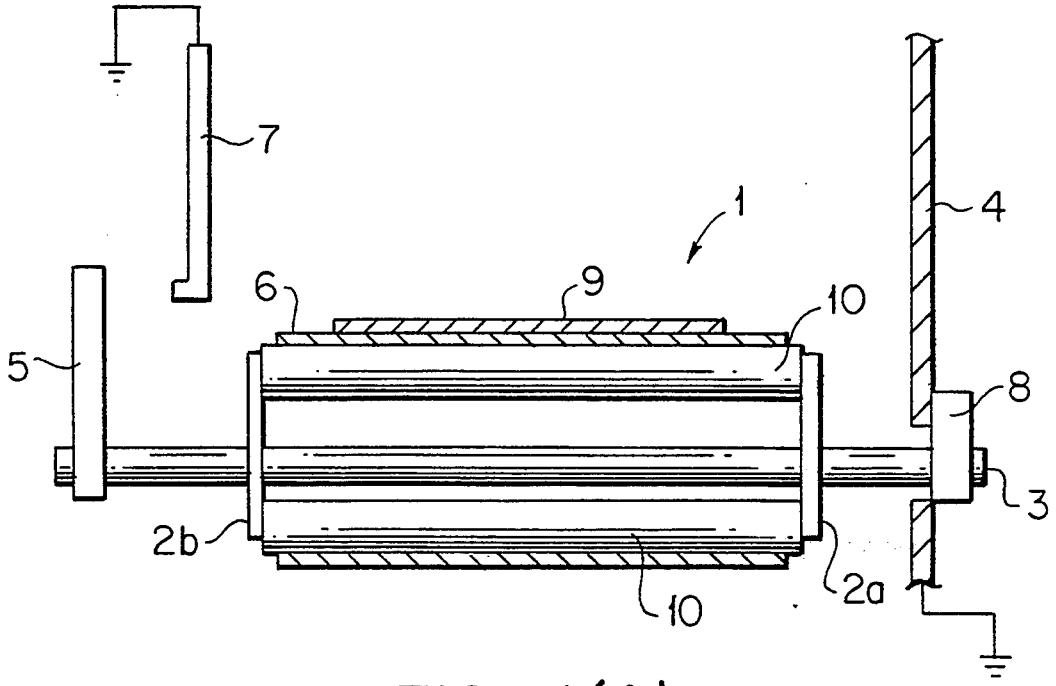
FIG. 1(A) is a schematic section view of a transfer material carrier unit employed in a first embodiment according to the present invention, showing the state in which the unit is disposed within a main body of a copying machine.
Figure 1B:
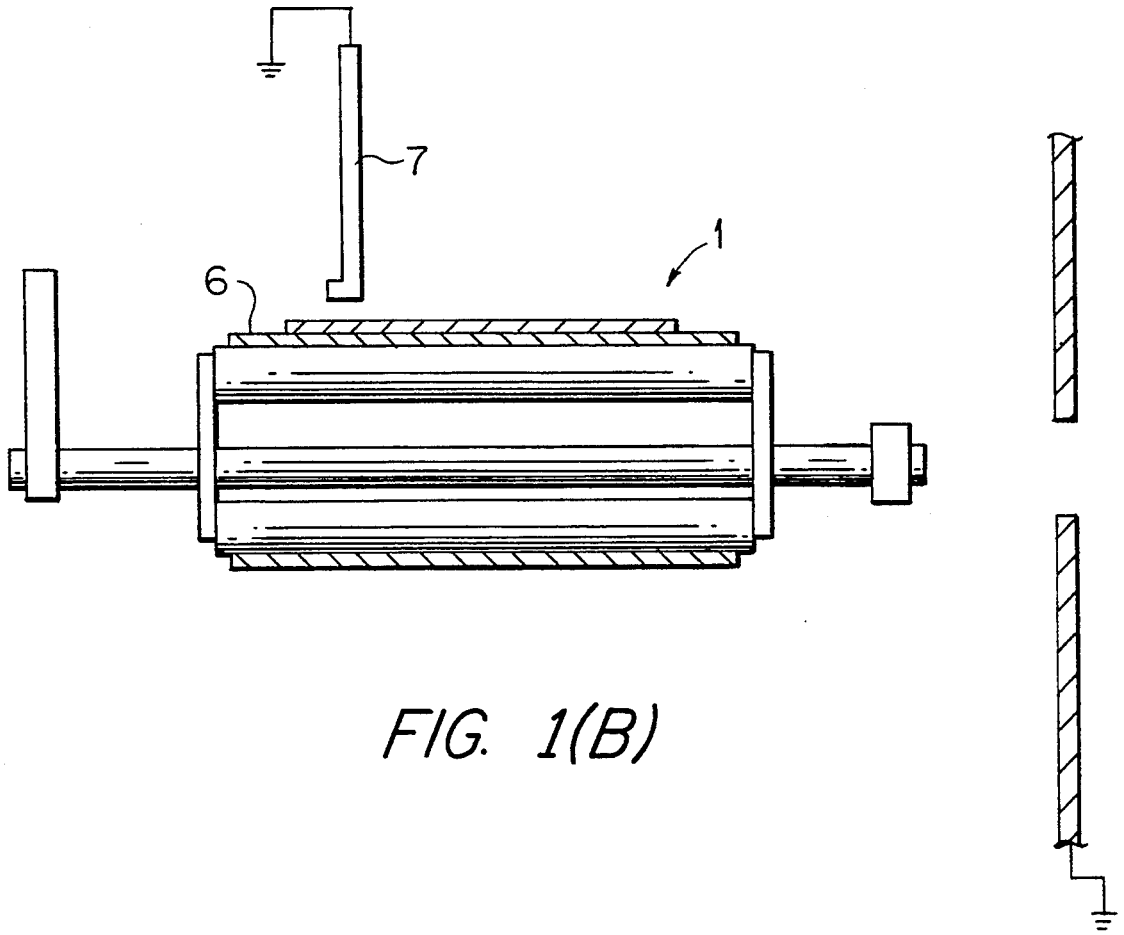
FIG. 1(B) is a schematic section view of the transfer material carrier unit, showing the state in which the unit is drawn out of the copying machine main body.

FIG. 1 shows a structure of a transfer material carrier unit according to a first embodiment of the present invention. In particular, FIG. 1(A) illustrates a state in which a transfer material carrier unit 1 is disposed at a normal position and, in this state, the transfer material carrier unit 1 is stored in the main body of a copying machine and is also in connection with the copying machine main body. On the other hand, FIG. 1(B) illustrates a state in which the transfer material carrier unit 1 is drawn and moved out from the copying machine main body when paper clogging is removed.

In FIG. 1(A), reference character 1 designated a transfer material carrier unit, 2*a* and 2*b* respectively stand for the rear and front frames of the transfer material carrier unit 1, and 3 expresses a rotary shaft for supporting the transfer material carrier unit 1, the rotary shaft being mounted such that it can be rotated freely with respect to the rear and front frames.

4 designates a frame of the copying machine main body, with the frame being grounded. 5 stands for an operation handle which is used to draw out the transfer material carrier unit. 6 designates a transfer material carrier belt, 7 a conductive member for removing electricity from the transfer material, 8 a member for preventing removal of the transfer material carrier unit, 9 a transfer material, and 10 a belt carrying roller.

Figure 2:
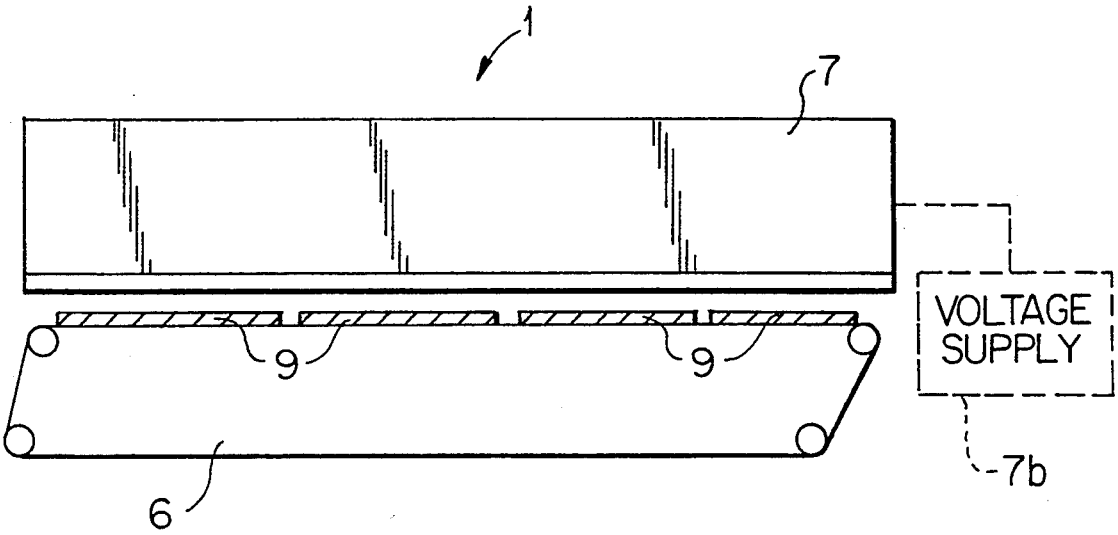
FIG. 2 is a schematic view of the transfer material carrier unit shown in FIG. 1(A), when viewed from the side of the surface.
Figure 3:
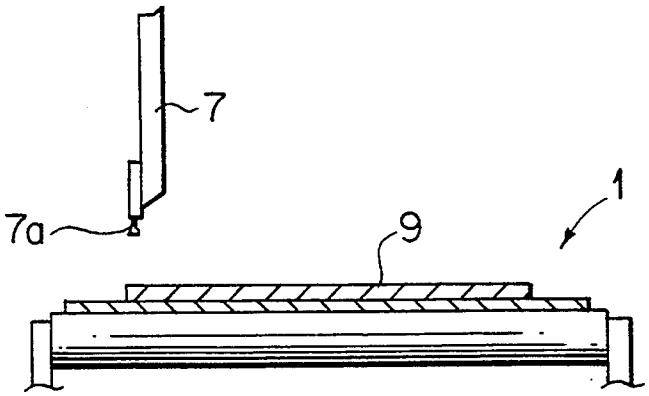
FIG. 3 is a schematic section view of a transfer material carrier unit employed in the second embodiment according to the present invention.

The conductive member 7 is fixed to the copying machine main body and is disposed such that the leading end thereof is opposed to the transfer material at a space distance corresponding to the quantity of charges of the transfer material on the transfer material carrying belt. The conductive member 7, as shown in FIG. 2, is arranged such that it is opposed to the transfer material 9 over the whole surface of the transfer material carrier unit 1. The leading end of the conductive member 7 may be formed in a flat form slightly greater in width, as shown in FIG. 1, or a conductive brush 7*a* may be mounted to the leading end of the conductive member 7, as shown in FIG. 3.

The conductive member 7 when connected to ground as shown in FIG. 1(A), faces the transfer material 9 and neutralizes charges on the transfer material due to the charges moving to the conductive member 7. Alternatively, as shown by the dotted line in FIG. 2, the conductive member 7 can be connected to a high voltage supply 7*b* to remove electricity forcibly. Further, brush 7*a* in FIG. 3 can be connected to a high voltage level to generate charges which neutralize the charges on the transfer material 9. In this configuration, if the conductive member 7 is connected to ground, the conductive member 7 and brush 7*a* are isolated from each other by insulation material.

Next, the operation of the present invention will be described. When starting the operation to remove the paper clogging, the transfer material carrier unit 1, as shown in FIG. 1(A), is in connection with the copying machine main body and, therefore, there is formed a path which is composed of the handle 5→rotary shaft 3→transfer material carrier unit removal preventive member 8→copying machine main body frame 4→ground (earth). When an operator touches his or her hand on the handle 5, then electric charges stored in the body of the operator are discharged out through the above path to neutralize the operator body electrically and, after then, even if the operator touches the charged transfer material, no electric shocks are given to the operator any longer.

Next, when the transfer material carrier unit 1 is pulled out from the copying machine main body as shown in FIG. 1(B), the electric charges are moved from the transfer material 9 to the conductive member 7 to thereby remove the charges stored in the transfer material therefrom. As a result of this, even if the operator touches the transfer material, the quantity of electric charges to be stored in the operator body is small and, therefore, after even when the operator touches the other conductive member, no electric shocks will be given to the operator body any longer.

In the above-mentioned embodiment, the present invention is applied to an intermediate transfer material carrier unit. However, the present invention is not limited to this but it can also be applied to all of other devices, provided that it charges electrically and carries a transfer material.

According to the present invention, since electricity is removed from the charged transfer material when the transfer material carrier means is drawn out from the image forming device, the electricity removing effect in removing the paper clogging can be enhanced to thereby prevent electric shocks. Also, the employment of a structure for performing an electricity removing operation in a manner of non-contact with the transfer material prevents unfixed toner from scattering.

What is claimed is:

1. An image forming device including transfer material carrier means for absorbing a transfer material onto a transfer material carrier by use of an electrostatic force and carrying the transfer material, said device comprising:

means for connecting said transfer material carrier means within a main body of said image forming device;

means for drawing out said transfer material carrier means from said image forming device main body by releasing connection of said connecting mean; and a conductive grounding member, disposed in said image forming device main body, is parallel to said transfer material and there is a space between said conductive grounding member and said transfer material when said transfer material carrier means is drawn out; wherein said image forming device main body is grounded, a path is formed for discharging electric charges from said means for drawing out said transfer material carrier means through said transfer material carrier means and said connecting means in a connected condition, and electricity is removed by said conductive grounding member in a connection released condition.

2. An image forming device as set forth in claim 1, wherein said conductive grounding member comprises means for generating electric charges in such a manner that an electric field is formed concentratedly so as to neutralize charges stored in said transfer material.

3. An image forming device as set forth in claim 1, wherein said conductive grounding member is connected to a high voltage supply source to remove electricity forcibly from said transfer material.

4. An image forming device as set forth in claim 1, wherein said transfer material carrier means carries a plurality of transfer materials simultaneously.

5. An image forming device as set forth in claim 1, wherein said conductive grounding member extends along a path for carrying said transfer material.

* * * * *

UNITED STATES PATENT AND TRADEMARK OFFICE

CERTIFICATE OF CORRECTION

PATENT NO. : 5,444,523

DATED : August 22, 1995

INVENTOR(S) : Junichirou SAMESHIMA et al

It is certified that error appears in the above-indentified patent and that said Letters Patent is hereby corrected as shown below:

Claim 1, column 6, line 14, "mean" should read --means--.

Signed and Sealed this

Twenty-seventh Day of August, 1996

*Attest:*

Bruce Lehman

BRUCE LEHMAN

*Attesting Officer*

*Commissioner of Patents and Trademarks*